US005669438A

United States Patent [19]

Beales et al.

[11] Patent Number: 5,669,438

[45] Date of Patent: Sep. 23, 1997

[54] CORRUGATED COOLING FIN WITH LOUVERS

[75] Inventors: Duane Victor Beales, Gasport; Henry Earl Beamer, Middleport, both of N.Y.

[73] Assignee: General Motors Corporation, Detroit, Mich.

[21] Appl. No.: 697,845

[22] Filed: Aug. 30, 1996

[51] Int. Cl.[6] ..... F28D 1/02

[52] U.S. Cl. ..... 165/152; 165/183; 29/890.046

[58] Field of Search ..... 165/152, 183; 29/890.046, 890.045

[56] References Cited

U.S. PATENT DOCUMENTS

| | | | |
|---|---|---|---|
| 2,011,854 | 8/1935 | Emmons et al. | 165/152 |
| 3,003,749 | 10/1961 | Morse | 257/130 |
| 3,104,701 | 9/1963 | Jacoby, Jr. | 29/890.046 X |
| 3,250,325 | 5/1966 | Rhodes et al. | 165/153 |
| 3,265,127 | 8/1966 | Nickol et al. | 165/152 |
| 3,433,044 | 3/1969 | Rhodes et al. | 29/890.046 X |
| 4,593,756 | 6/1986 | Itoh et al. | 165/151 |
| 5,035,052 | 7/1991 | Suzuki et al. | 29/890.046 |
| 5,176,020 | 1/1993 | Maruo et al. | 72/186 |
| 5,289,874 | 3/1994 | Kadle et al. | 165/152 |

*Primary Examiner*—John Rivell
*Assistant Examiner*—Christopher Atkinson
*Attorney, Agent, or Firm*—Patrick M. Griffin

[57] ABSTRACT

A louvered, corrugated cooling fin (42) has its louvers (48) bent out of the fin walls (44) in a novel configuration. Rather than being bent out of the fin wall (44) about central, lengthwise axes that are square to the fin wall (44), the louvers (48) are bent out, at shallow angles, about axes that run corner to corner of the louver, axes which are not square to the fin wall (44). As a consequence, rather than moving on lengthwise half of the louver (48) to each side of the fin wall (44), one diagonal half of the louver (44) is moved to each side of the fin wall (44). Another consequence is that diagonally opposed corners of the louvers (48) are shifted out of constricted areas (C) between the fin wall (44), and into less constricted areas (O), allowing greater louver length, greater effective louver opening depth (D'), and better overall air flow.

3 Claims, 7 Drawing Sheets

CORRUGATED COOLING FIN WITH LOUVERS

TECHNICAL FIELD

This invention relates to an improved design for the louvers that are bent out of the flat walls of corrugated cooling fins used in heat exchangers.

BACKGROUND OF THE INVENTION

The present invention can be better understood after a detailed description of the current state of the art and the drawings representing it, in which:

FIG. 1 is a schematic perspective view of the base walls of a corrugated fin, showing the location of a pair of heat exchanger tubes in dotted lines and showing general air flow direction by arrows;

FIG. 2 is a view of the lead edge of the corrugated fin viewed in the general direction of air flow;

FIG. 3 is a perspective view of a typical cooling fin with conventional multi-louver design;

FIG. 4 is a schematic showing the orientation of a single typical louver;

FIG. 5 is a view of the cooling fin of FIG. 3 looking at the lead edge, in the direction of air flow;

FIG. 6 is a cross section taken along the line 6—6 of FIG. 5;

FIG. 7 is a view of the lead edge of an older fin style incorporating single, alternating louvers;

FIG. 8 is a cross section taken along the line 8—8 of FIG. 7.

Referring first to FIGS. 1 and 2, parallel flow heat exchangers incorporating a parallel, closely spaced array of flat liquid flow tubes, with corrugated fins (often called air centers) breed between the tubes, are one of the oldest types of heat exchangers found in automotive application. Radiators have been made to that basic plan for decades, and other heat exchangers, such as condensers, have followed the same basic design for at least a couple of decades. As shown in FIG. 1, a pair of flat flow tubes 20 (shown in dotted lines) contains therebetween a corrugated fin indicated generally at 22. Fin 22 is made up of a series of thin, flat fin walls 24, folded relative to one another about crests 26. The crests 26 are radiused into a semi-circle, rather than sharply pointed like the apex of a V, so as to be less prone to damage, and so as to braze better to the surface of the tubes 20. The semi-circular shape leaves wedge shaped pockets to both sides of the outer surface of a crest 26 where it contacts the outer surface of a tube 20, allowing for braze material to be drawn in by capillary action and create solid braze fillets. Although the crests 26 are not pointed and sharp, the fin walls 24 can themselves have a V or divergent shape, rather than parallel to one another, as shown. However, in the limiting case, the fin walls 24 can be packed so closely as to be effectively parallel to one another, with a constant wall-to-wall separation equal to the chord formed by the arc of the inner surface of the semi-circular crest 26. In either case, each fin wall 24 has a predetermined width W measure crest-to-crest, and a length measured along the crest 26. When the crests 26 of a fin 22 are brazed to the opposed outer surfaces of each pair of parallel tubes 20, they form a series of adjacent flow passages F, which have two longer sides and two shorter ends. The sides of the flow passages F are formed by the inner surfaces of two adjacent fin walls 24. One of the opposed ends of each flow passage F is formed by the concave inner surface of one crest 26 (whose outer surface is brazed to one tube 20) and the other end by a segment of the outer surface of the other tube 20, a segment which is itself bordered by the convex outer surfaces of two adjacent fin crests 26. Each side of each fin wall 24 faces, therefore, into one of an adjacent pair of flow passages F. Cooling air is pulled by a fan through the air flow passages F in the direction of the arrows, over the surfaces of the fin walls 24, thereby helping to draw heat out of a hotter fluid or liquid flowing through the tubes 20, which may be engine coolant, refrigerant, etc. Technically, of course, air is a fluid as well, and the heat flow may in fact be in the opposite direction, as in an evaporator. One end of each flow passage F is more constricted, that being the narrower area located just inside the concave inner surface of a single crest 26, indicated at C. The opposite end is less constricted, being a wider and more open area indicated at O, located along the inner surface of the segment of tube 20 and bordered by the convex, diverging outer surfaces of two adjacent crests 26. This difference in width between the two areas C and O is much greater when the fin walls 24 are V shaped and divergent, of course, than when they are parallel, but the curvature (inside or outside) of the crests 26 creates a difference in either case. Also, heat flow out of the tube 20 and into the flow passage F will be less restricted at the wider area O than the narrower area C, because it does not have to flow through the extra thickness of the material in a fin crest 26.

Following standard heat flow optimization theory for compact heat exchangers, the trend from early on has been to pack more (and more closely spaced) tubes like 20 within the available cooling air flow area (increasingly limited by decreasing grill size in the case of radiators and condensers). This obviously exposes more (and more surface area of) liquid flow to the cooling air flow. Doing so also obviously requires thinner and thinner tubes, so as not to counter productively block the flow of cooling through and around the extra tubes. The history of heat exchanger optimization has thus closely tracked the technology of tube manufacture, and tube manufacturers have continually worked to extrude the thinner tubes that heat exchanger manufacturers have demanded.

The other flow that designers have sought to optimize is the air flow over the fins, and this has led to changes in fin design. More closely packed tubes have inevitably led to narrower fins (as measured crest to crest) and the venerable design imperative of improving heat flow by minimizing flow passage hydraulic diameter (within the limits of acceptable pressure drop) has yielded more closely packed fin walls, that is, fins with tighter radii at the crests and even narrower flow areas inside the fin crests. These are all consequences of the known efficiencies inherent in making heat exchangers more and more compact. Another long time trend in fin design has been the attempt to improve the heat transfer efficiency of air flowing over the surfaces of the fins by breaking up and minimizing the formation of laminar flow layers at the fin surface, which act as insulators that retard heat flow, both conductive and convective. For over three decades now the standard means for preventing such flow boundaries have been narrow louvers bent out of the fin walls, creating openings which extend slightly above the fin wall surface and into the air flow.

Referring to FIG. 1, the most common current louvered fin design is a so called "multi-louver" design, in which the louvers are divided up into a pattern of alternating, adjacent sets of louvers, most often just two sets, a lead set indicated schematically at L and a trailing set T. However, there may be three or more sets of louvers on longer fins. As best seen in FIGS. 3 and 4, a conventional single louver 28 is a narrow rectangle bent integrally out of the fin wall 24, and in effect rotated by a shallow angle θ about an axis that runs lengthwise through the center of the louver 28, square or perpendicular to the crest 26. This is indicated schematically in FIG. 4, which shows just the main body of the louver 28 and the lengthwise axis of rotation in dotted lines, but does not show the sharp, short webs at the ends (visible in FIG. 3) where louver 28 integrates into the fin wall 24. So rotating the louver 28 serves to move one lengthwise half of louver 28 to one side of fin wall 24 and the other half to the other side of fin wall 24, one half each into the two adjacent flow passages F that border the fin wall 24. The angle of rotation θ is small, generally less than thirty degrees, and the width of louver 28 is small, often less than one millimeter, which is significantly less than its length. Still, the rotation of louver 28 serves to raise its edges above surface of the fin wall 24 to an effective depth (indicated at D in FIG. 4), which creates a visible opening large enough to affect the air flow over fin wall 24 in a fashion detailed below. A number of such identical louvers 28 are arranged side-by-side, at the same angle and facing in the same direction. These are arranged in a double pattern, with one set sloped in one direction on the front half of fin wall 24 (the lead set L), and the other half sloped in the other direction (but at the same shallow angle) on the trailing half of fin wall 24 (the trailing set T). The patterns are as tightly packed as possible, like louvers in a window blind, with no residual fin wall material left between adjacent louvers 28. The first louver and last in each series are only half width, but have the same length. The two sets L and T are separated from one another by a central "turn around" rib 30, toward which the two sets of louvers converge. The plane of the turn around rib 30 is offset above the plane of fin wall 24 by the same depth D noted above, so that the edges of the last louver 28 in the lead set L and of the first louver 28 in the trailing set T merge into the surface of the turn around rib 30.

Referring next to FIGS. 1, 3, and 6, the physical interrelationship of louvers 28 in successive and adjacent fin walls 24, which is important to the operation of a typical multi-louver pattern, is illustrated. Since each fin wall 24 is identical, it will be understood that if the surface of the fin wall 24 is turned so as to sight directly along any louver 28, one will see through a number of nearly aligned openings in successive fin walls 24, as best seen in FIG. 3. This is not a perfect alignment when the fin walls 24 are divergent and not parallel, however. Because the louvers 28 are parallel to the fin walls 24 from which they are bent, but the fin walls are not themselves parallel to each other, the edges of those louvers 28 in successive fin walls 24 that are partially aligned will actually be seen to crisscross with each other at a shallow angle. When the fin walls 24 are themselves parallel, the louvers 28 in successive fin walls 24 will be better aligned. The openings are well enough aligned in either case, however, to create a characteristic louver flow described next.

Referring next to FIG. 6, when air flows through the flow passages F, in a direction parallel to the crests 26, it will initially engage the louvers 28 of the lead pattern L. When the portion of the initial air flow closest to the surfaces of the fin walls 24 engages the openings between the lead edges of adjacent louvers 28 in the lead pattern L, it will be caught and deflected through the fin wall 24, (deflected up as seen in FIG. 6), substantially at the angle of the lead pattern louvers 28. Air so deflected will not absolutely follow the angle of the louvers 28, of course, but will have a resultant velocity as it is impacted by air flowing straight between, and farther from, the surfaces of the fin walls 24. The air flow so deflected can continue through the aligned openings of the louvers 28 of several of the adjacent fin walls 24, as shown by flow lines in FIG. 6. Specifically, in the one flow stream illustrated by a continuous line, air deflected through the first opening in the lowest fin wall 24 passes through the third opening of the next fin wall 24, then the fifth, seventh, ninth, and finally the eleventh openings in the next five successive fin walls 24. Finally, air in the deflected stream shown flows between a pair of adjacent turnaround ribs 30 in the uppermost two fin walls 24 shown in FIG. 6. From there, the air flow is deflected at the same angle, but in the opposite direction, and back through the louvers 28 of the trailing pattern T in the same way. All of this deflection of air flow, as indicated above, serves to "cut" and break up the laminar boundary flow layer that would otherwise occur along the surfaces of the fin walls 24, improving thermal transfer.

Older louvered fin designs were significantly wider, less tightly packed than the multi-louver fin 22 just described, and were arranged in a different pattern. As shown in U.S. Pat. No. 3,265,127 issued Aug. 9, 1966 to Nickol, et al, single, wider louvers 27 were bent out of the fin wall, separated by intervening webs of remaining fin wall material. Every louver 27 on each fin wall alternated in slope, rather than being arrayed in two sets with the same slope in each set. As with the multi-louver patterns, the louvers were generally rotated about an axis square to the fin wall, but all of the width of the louver itself was shifted to one side or the other of the fin wall, rather than one lengthwise half to each side of the fin wall. The leading edges of such alternating louvers were typically parallel to the fin wall plane. However, as shown in FIGS. 7 and 8, alternating type louvered fins have been used, also with flat fin walls 34 joined by fin crests 36, in which the alternating louvers 38 bent out of the fin walls 34 were more tightly packed (i.e., not separated by intervening webs of material in the fin wall 34), and also had leading edges not perfectly parallel to the plane of the fin wall 34 from which they were bent. Like the other alternating type louvers, however, the louvers 38 were bent so as to shift all of their area to one side or the other of the fin wall 34.

Multi-louvers like those just described have found increasing use over the older, alternating louver pattern, as the technology has evolved to form them in the very small widths and tightly packed patterns shown. Die wheels having very sharp and closely spaced teeth engage fin strip stock to cut the louver patterns with a good regularity and uniformity. With louvers in either the multi-louver or single, alternating louver pattern, however, there is a real and common limitation as to how long the louver can be made, as a proportion of total fin wall width W. As can be seen by comparing FIGS. 5 and 7, because of the way both the louvers 28 and 32 are bent and formed, one corner of one end of each louver is bent out into the narrower flow passage area inboard of a fin crest. Those louver ends crowd the corresponding ends of the louvers in adjacent fin walls that are bent inboard into the same fin crest. No matter how narrow the louver or how shallow its angle, that common and inevitable limitation remains. The current state of the art in louver formation, therefore is that louvers must extend, at least partially, inboard of a fin crest, but cannot do so to a depth that is any more than half the inside width (or radius) of that fin crest, so as to avoid interference. For a louver of any given width, this translates into a limitation on that louver's effective length. Again, this is because of the way in which the louvers of either design are bent out, along an axis that is square to the fin wall, and always so as to move one end of each louver inboard of a fin crest. There appears to be no known teaching of how to bend an operational fin louver so as not to move one of its ends or corners inboard of a fin crest. Besides the limitation on length of the louver, a keyhole or eyelet shaped passage 40 is left in both fins 22 and 32 between the central inner surface of the crest and the ends of the louvers that are bent out into it. Passage 40 is effectively isolated and blocked from the deflected air flow created by the louvers.

SUMMARY OF THE INVENTION

A corrugated cooling fin with louvers in accordance with the present invention is characterized in general by the features specified in claim 1.

More specifically, each louver made according to the invention is, like conventional louvers, bent integrally out of the fin wall and is basically rectangular, with a width much less than its length. The louvers are also preferably arranged in the same basic multi-louver pattern, with two sets of oppositely sloped, leading and trailing louvers separated by turn-around ribs. The louvers are bent out of each fin wall in a very different manner, however, which has significant consequences to its operation.

Instead of being bent out about a central axis that is square to the fin, the louvers of the invention are bent out of the fin at a comparable angle, but about an oblique axis that runs between two diagonally opposed corners in the louver, rather than lengthwise through the center. The oblique axis of bending serves to pull the other two diagonally opposed corners of the louver entirely out of the constricted, concave area inside a fin crest, and, concurrently, more deeply into the unconstricted, wider areas of two adjacent flow passages. Since the diagonally opposed louver corners are pulled out through the outer surfaces of the crests, rather than being pushed into the constricted inner areas of the fin crest, the louvers' length restriction noted above is eliminated. Also, there is no constricted and isolated flow area created just inside the fin crest, since the louver ends are not moved inboard of the fin crest. Rotating the louver about an oblique axis also creates an effectively deeper louver opening in the less constricted ends of the flow passages, which serves to scoop more air flow through the fin wall that might otherwise pass through. The effectively deeper louver openings at each end of each louver are also brought closer to the tube surface in those areas where the tube surface is bordered by the outer surfaces of adjacent fin crests.

All of these differing physical louver characteristics and interrelationships follow from their novel, oblique bending axes, and some or all of these resultant characteristics lead to a marked improvement in fin performance that has been measured. Although the factors at work are not yet perfectly understood, the improvement in performance, as quantitatively measured, has been significant.

BRIEF DESCRIPTION OF THE DRAWINGS

These and other features of the invention will appear from the following written description, and from the drawings, in which.

DESCRIPTION OF THE PREFERRED EMBODIMENT

Figure 1:
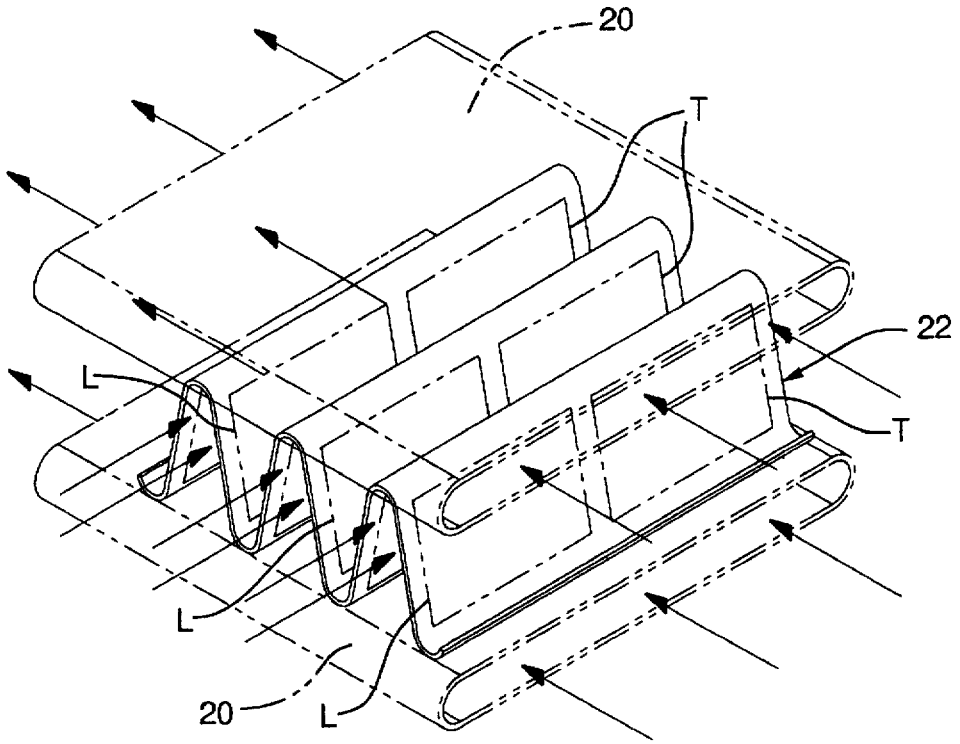
PRIOR ART FIG. 1

Referring again to FIGS. 1 and 2, the cooling fin of the invention would be used in the same kind of heat exchanger having flow tubes with the same size, material and configuration as that described above. The general shape and spacing (or pitch) of a fin made according to the invention would be the same, as well. Consequently, the flow passages F created by the fin of the invention, when brazed between the tubes 20, would have the same size and shape. Therefore, all of the general discussion above as to air flow applies here, as well. All that would have to be changed in order to produce the fin of the invention would be the tooling that actually cuts the louvers into the fin wall, and even that would be the same basic type of tool, just modified to create the new louver shape and orientation. Consequently, there would be essentially no extra cost involved in producing a new heat exchanger design with the cooling fin of the invention, the details of which are given below.

Figure 9:
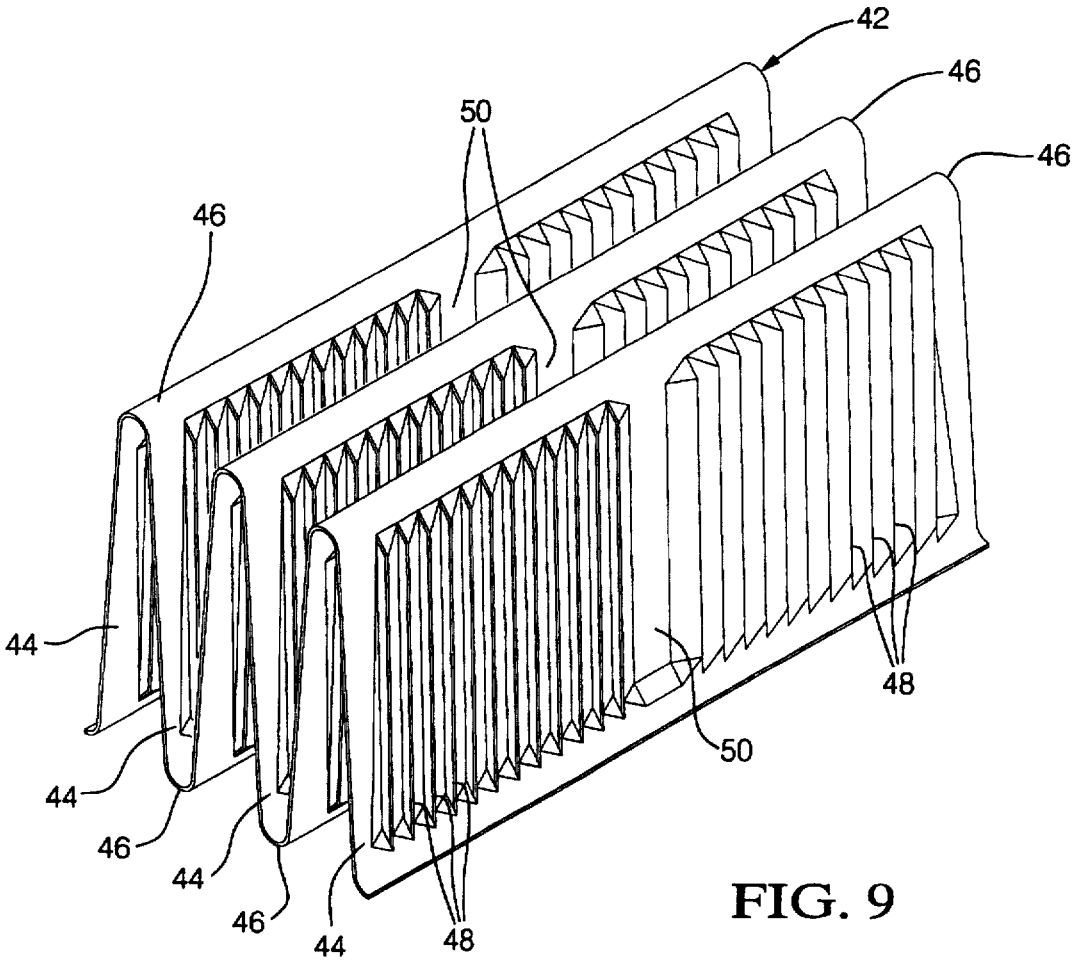
FIG. 9 is a perspective view of a multi-louvered cooling fin made according to the invention.
Figure 10:
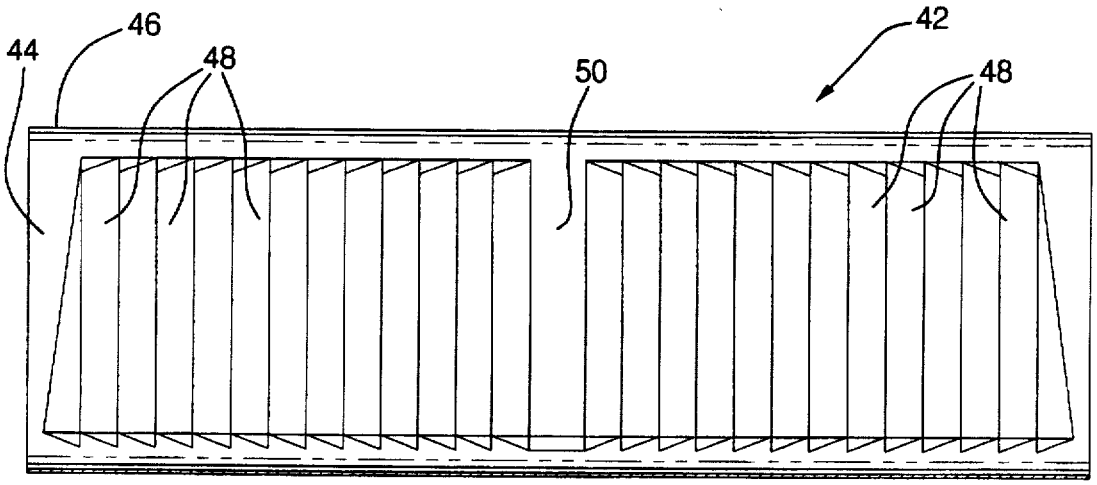
FIG. 10 is a side view of one fin wall.

Referring next to FIGS. 9 and 10, a preferred embodiment of a cooling fin made according to the invention is indicated generally at 42. Just like the prior art cooling fin 22 described above, cooling fin 42 has a series of flat fin walls 44, joined at radiused crests 46, of comparable fin width W. Fin thickness and material are the same. A series of louvers 48, also rectangular and with a length much greater than the width, is bent out of the fin wall 24, in the same general pattern of oppositely sloped, leading and trailing sets as described above. A similar turn around rib 50 separates the two sets of louvers. As with fin 22, the fin walls 44 could be in a non parallel, V shaped orientation as illustrated, or more U shaped and nearly parallel. Either way, the flow passages F will have a constricted area inboard of the concave inner surface of a crest 46, and a less constricted, wider area opposite, along the outer surface of the segment of flow tube 20 and bordered by the convex, diverging outer surfaces of two adjacent fin crests 46. As such, the fin 42 could be substituted directly for the fin 22 described above. The difference between the two fins 22 and 42 resides in the orientation of the axis about which the louvers 48 are bent out of the fin walls 44, described next.

Figure 11:
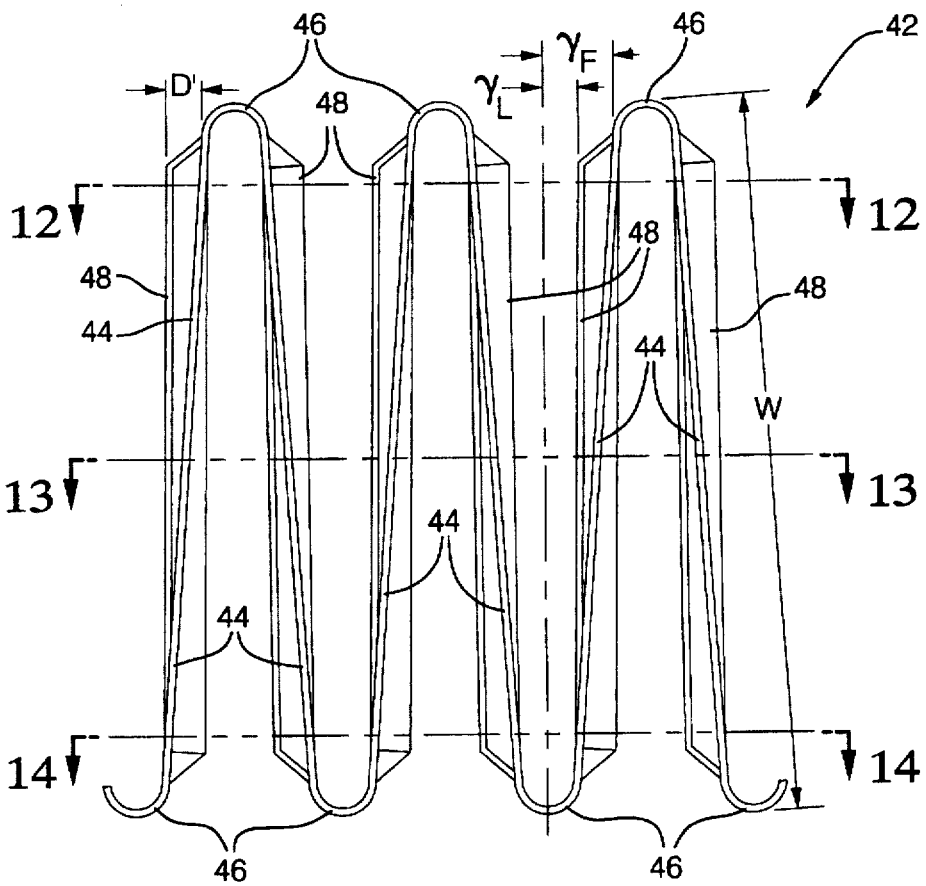
FIG. 11 is an end view of the cooling fin.
Figure 15:
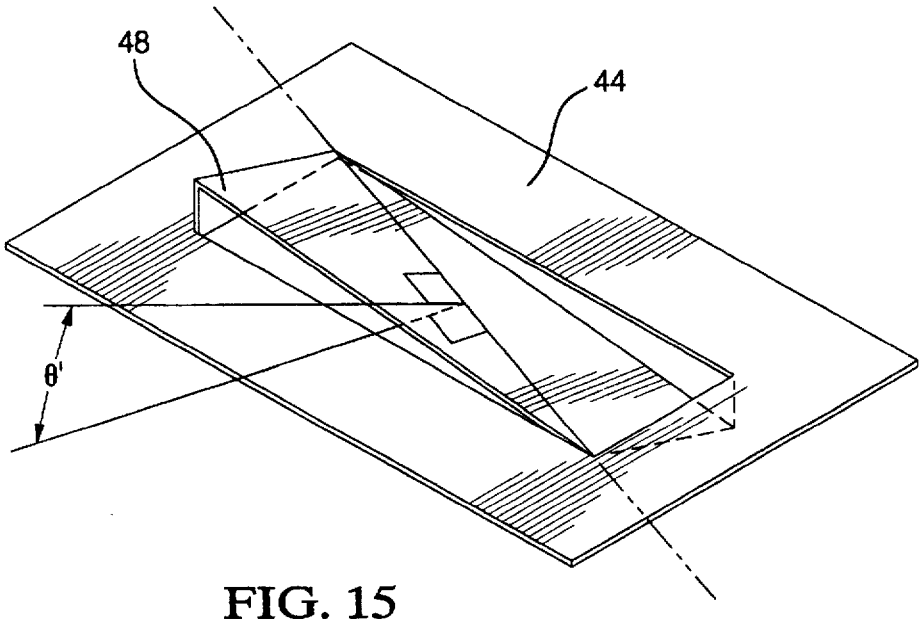
FIG. 15 is a schematic view showing the orientation of a single louver made according to the invention.
Figure 14:
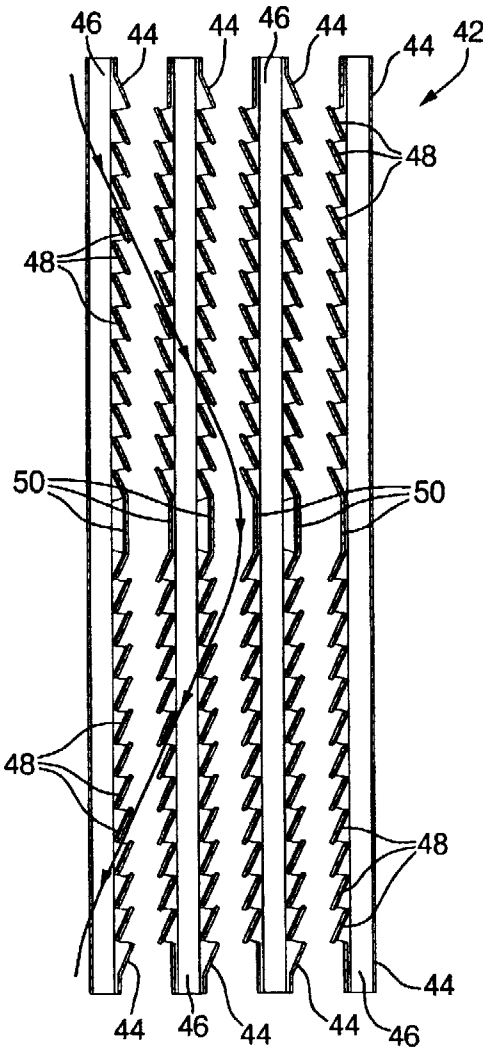
FIG. 14 is a cross section of the fin taken along the line 14—14 of FIG. 11.
Figure 13:
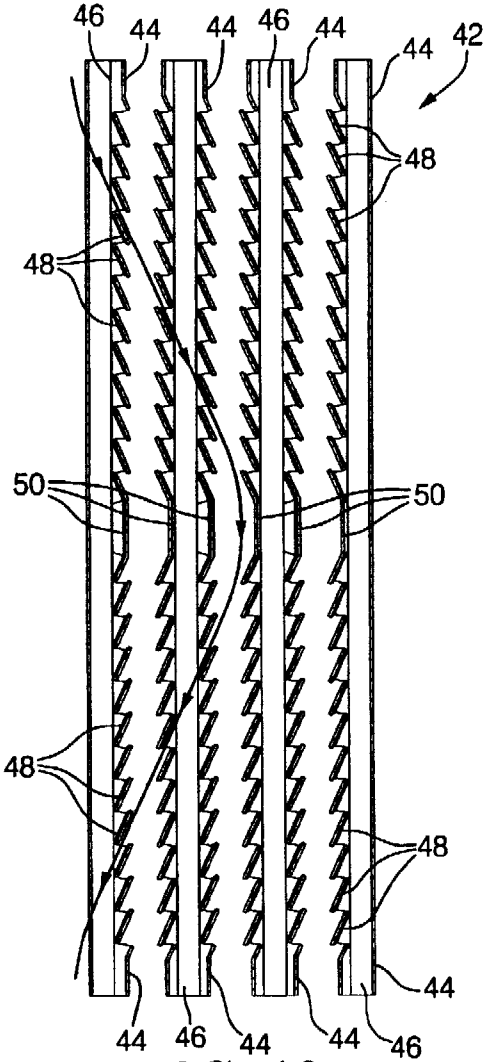
FIG. 13 is a cross section of the fin taken along the line 13—13 of FIG. 11.
Figure 12:
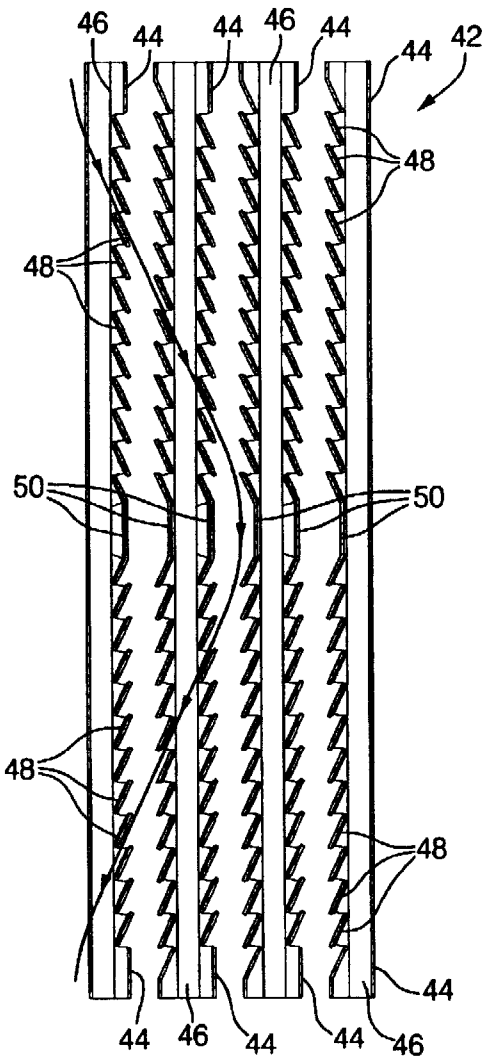
FIG. 12 is a cross section of the fin taken along the line 12—12 of FIG. 11.

Referring next to FIGS. 10, 11 and 15, the louvers 48 are not rotated about an axis that is square to the fin wall 44 (perpendicular to the fin crest 46), nor are the ends or corners of the louver 48 thereby moved into the constricted areas of the flow passages F, inboard of the inner surface of a fin crest 46. Instead, as best seen in FIG. 15, each louver 48 is tilted or skewed relative to its fin wall 44, rotated about an oblique axis (shown in dotted line) that runs corner to corner through the louver 48, rather than bisecting the louver 48 lengthwise, as is typical. Compared to a conventional louver 28, it is much more difficult to describe and measure the size of the angle θ' at which the louver 48 is rotated about the oblique axis, although it is comparable to the small angle at which a conventional louver is rotated about its non-oblique axis. To indicate the angle θ', a reference line has to be drawn perpendicular to the axis of rotation, since none of the edges of louver 48 are either square or parallel to the axis of rotation, and cannot be used as convenient reference lines, as with conventional louver 28. The angle between that reference line and a projection of it into the plane of the fin wall 44 is the angle of rotation θ' about the oblique axis. As a practical matter, what the designer can do, rather than specifying the particular angle of rotation, is to instead specify the resultant angle of the lengthwise leading edge of the louver 48 relative to a vertical line (a line perpendicular to the tubes 20), indicated at γL in FIG. 11. γL is about half of the corresponding angle γF for the leading edge of the fin wall 44 itself, and the leading edge of the louver 48 is thereby brought closer to vertical, about halfway back toward vertical, as compared to the leading edge of the fin wall 44 itself. Louver 28, by contrast, has an angle relative to vertical that is exactly equal to that of the fin wall 24 itself. Of course, if the fin walls 44 were parallel and vertical themselves, then γF would be zero, and γL would be effectively a negative angle.

Figure 2:
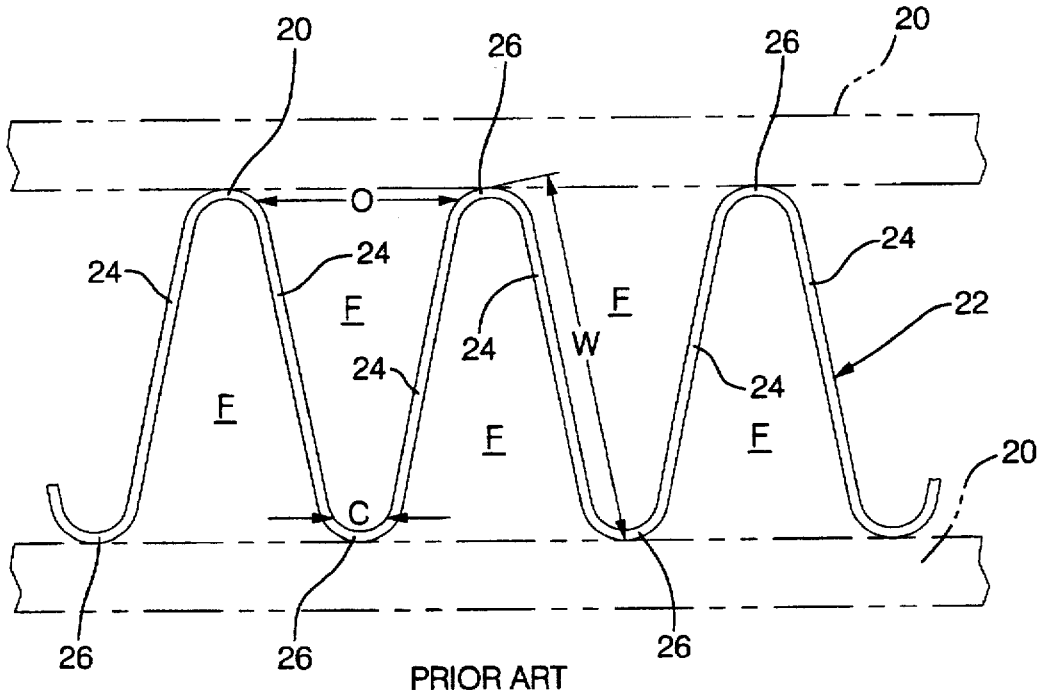
PRIOR ART FIG. 2
Figure 3:
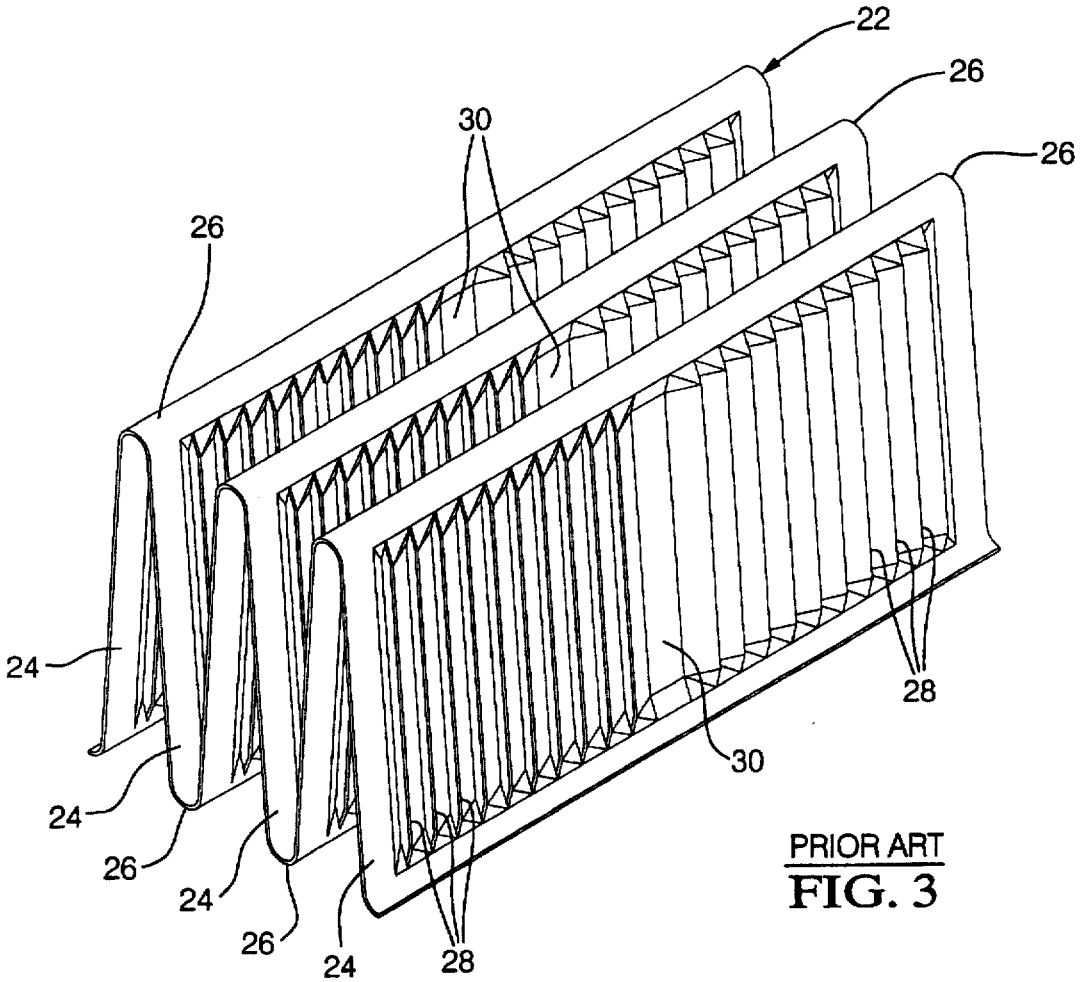
PRIOR ART FIG. 3
Figure 4:
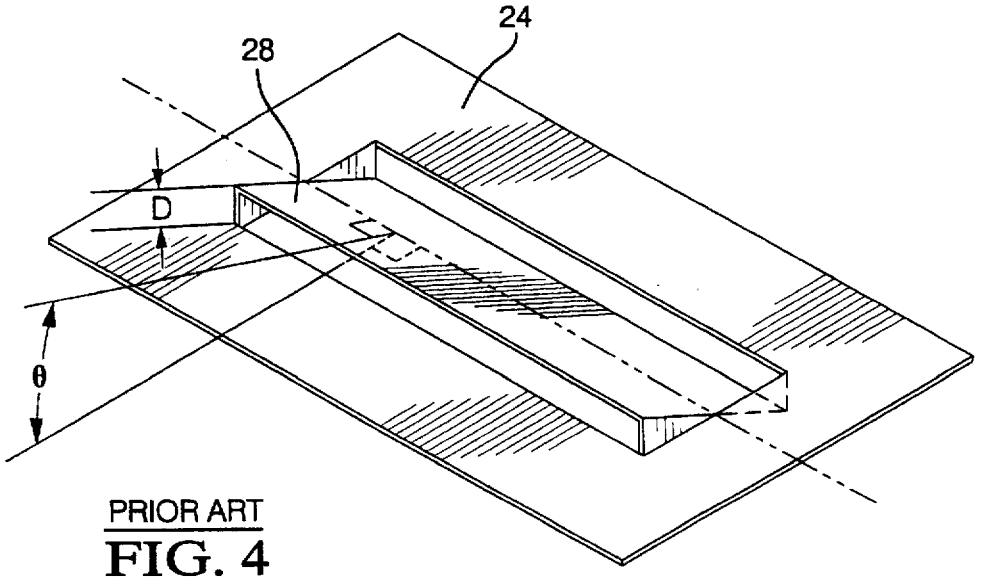
PRIOR ART FIG. 4
Figure 5:
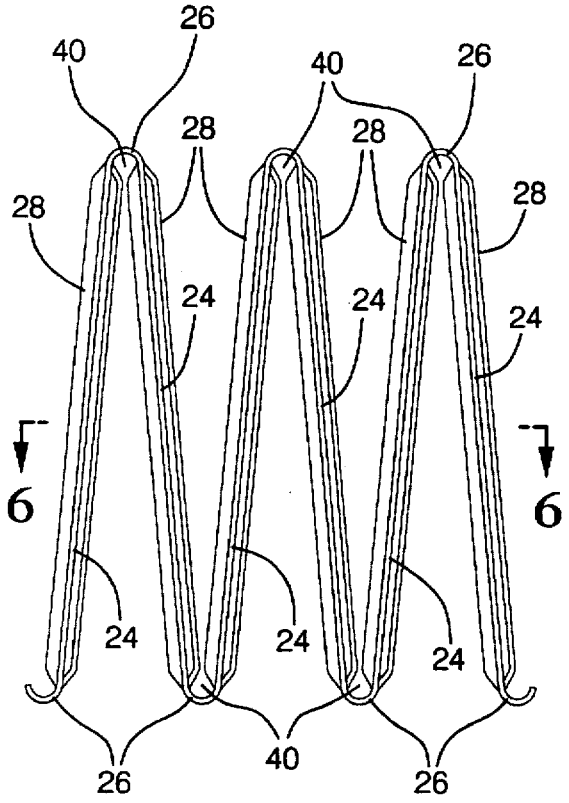
PRIOR ART FIG. 5
Figure 6:
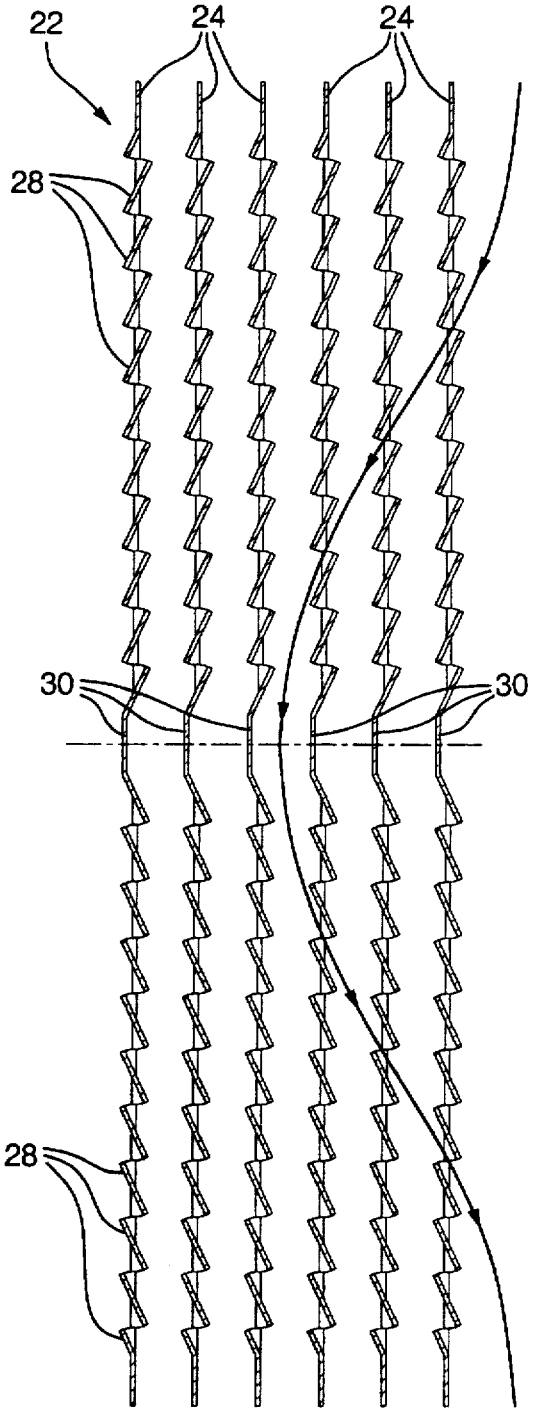
PRIOR ART FIG. 6
Figure 7:
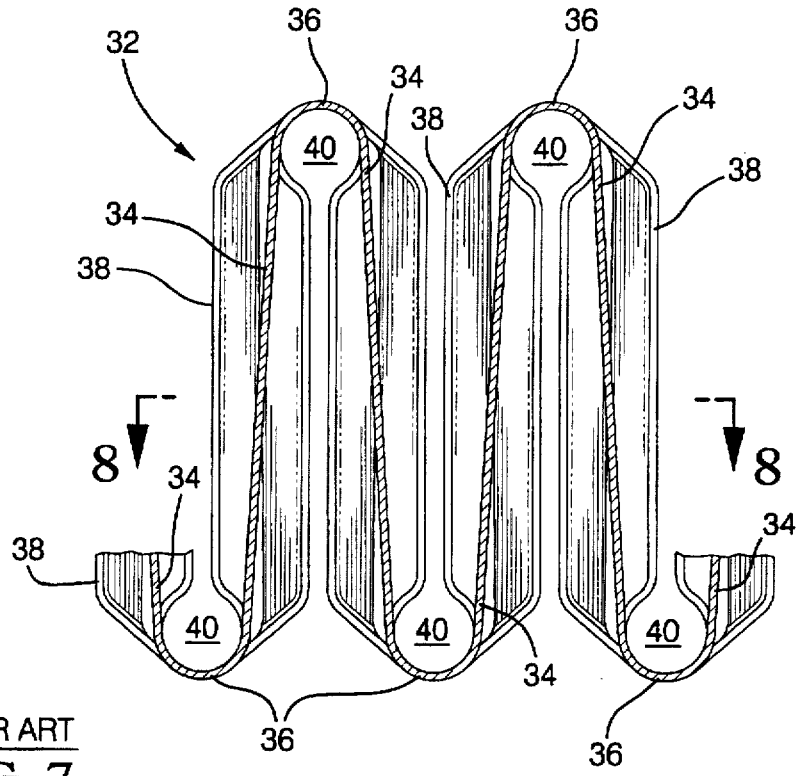
PRIOR ART FIG. 7
Figure 8:
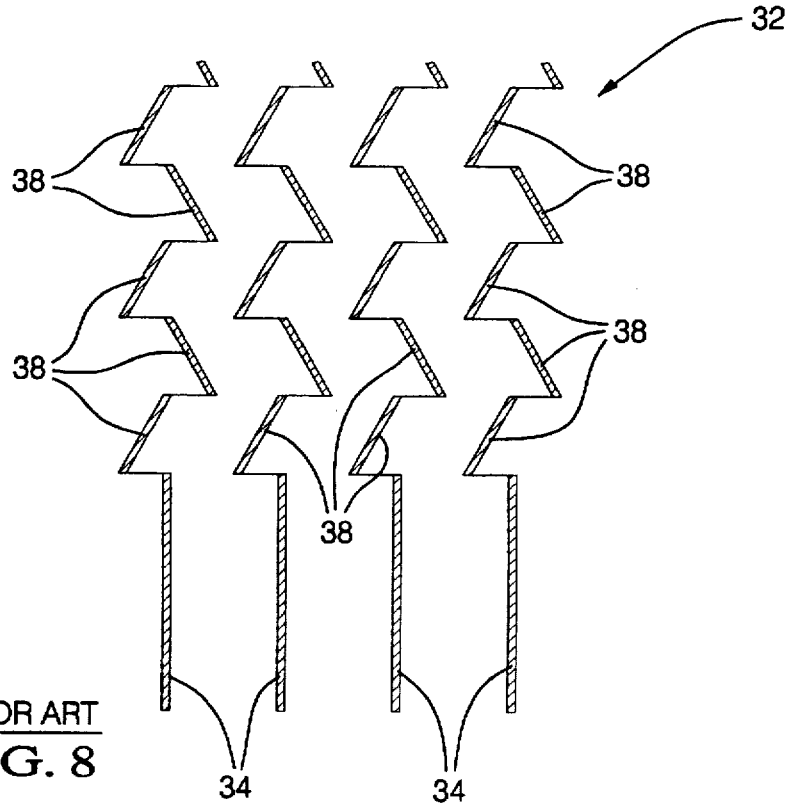
PRIOR ART FIG. 8

Referring next to FIGS. 2, 10 and 11, there are numerous physical consequences from the seemingly simple expedient of tilting or skewing the louver 48 relative to the fin wall 44 about an oblique axis. One consequence is the same regardless of whether the fin walls 44 are parallel to each other or V shaped and divergent. That is, that each of the other two remaining diagonal corners of louver 48, that is, each of the two diagonal corners that the oblique axis does not run through, is pulled through the convex outer surface of a fin crest 46, and out of the concave inner surface of a fin crest 46, to an effective depth D' that is greater that the equivalent depth D for fin 22 described above. Stated differently, the two remaining diagonally opposed corners of each louver 48 are pulled into the unconstricted, wider areas O of two adjacent flow passages F and, more importantly, concurrently pulled out of the constricted, narrower areas C. One diagonal half of each louver 48 is moved to one side of its respective fin wall 44, into one flow passage F, and the other diagonal half to the other side, and into the adjacent flow passage F. This as opposed to conventional multi-louver pattern louvers like 28, in which a lengthwise half is moved into each flow passage F, or the older, alternating pattern louvers, in which all of the louver material is moved to one side or the other of the fin wall. The only easily seen visual indication of this diagonal, non lengthwise bisection of the louver 48 is seen in FIG. 10, where the initial half louver 48 in the lead pattern L, and the final half louver 48 in the trailing pattern T, leave a "foot print" on the fin wall 44 that is a thin triangle, rather than a thin rectangle. What this means is that the length limitation on louvers like the louvers 28 described above no longer applies. That is, the diagonally opposed corners of louver 48 are shifted into the unconstricted area O of FIG. 2, where there is more room for them, and out of the constricted area C inside of a fin crest 46. The only restriction is that each louver 48 cannot be twisted out its respective fin wall 44 and outboard of a fin crest 46 so far as to interfere with the opposed louver 48 in the adjacent fin wall 44. However, that is much less of a restriction than preventing louver to louver interference inside of a fin crest 46. Therefore, each louver 48 can be made longer, as a proportion of total fin width W, than it otherwise could. In the embodiment disclosed, the proportion of end to end louver length compared to total fin width W was taken from a prior limit of 0.880 to 0.899. This represents only about a 2 percent increase in the ratio, but the increase in performance was greater than would have been expected for such a small increase, as will be described below. There is still a physical limitation on louver length insofar as room must be left for a web to integrate the ends of louver 48 into the plane of fin 44, and, in any event, the louver 48 could not be made so long as to cut right through and weaken the top of the crest 46, which must be brazed to the surface of the tube 20. However, the prior limitation on louver length is gone, and there is also no limitation imposed by the louvers 48 on how small the radius of the fin crest 46 can be made. The prior art teaches that the radius of the crest 46 cannot be made too small, for a given louver length, because of the presence of the potentially interfering ends of conventionally formed louvers. In other words, looking at FIG. 11, the radius of crest 46 could be reduced, pinched in about its center, and the fin walls 44 could be moved closer together, with no interference by any louver ends or corners residing inside the crest 46. Another physical change is the same for a fin with either parallel or V shaped fin walls, and that is that the diagonal corners that are pulled out of the inside, and to the outside, of the fin crest 46 are also brought closer to the surface of the flow tube 20, rather than blocking off an area like 40 described above, within the concave inner surface of the fin crest 46.

Referring to FIGS. 2, 9 and 11, some physical consequences of the differing orientation of the louver 48 are more pronounced in, or even unique to, the type of cooling fin 42 illustrated, that is, one in which the fin walls are divergent, rather than parallel. As best seen in FIG. 11, the long edges of louver 48 are pulled out into the flow passages F almost to a vertical orientation. They could be pulled farther out, right to a vertical orientation, and almost to an interfering point with adjacent fin walls 44, if desired. To do so, the louvers 48 would simply be rotated farther about the oblique axis, increasing the effective depth D'. The fact that the louvers 48 are rotated about an oblique axis at all, however large the angle, means that the leading edges of the louvers 48 are moved into an orientation where they are more nearly parallel to one another than the fin walls 44 themselves are to each other. In typical louvers like 28, the leading edges simply track the same non parallel relation that the fin walls 24 have. Therefore, if one were to sight straight in along the plane of a louver 48, with the fin 42 being in an orientation similar to FIG. 9, the openings the louvers 48 form in one fin wall 44 would be more nearly aligned with and parallel to the openings in adjacent and successive fin walls 44. The oblique bending of the louvers 48 in effect cancels out some of the non parallel nature of the fin walls 44 relative to one another.

Referring next to FIGS. 11 through 14, the deflected air flow created through the louvers 48 is very similar to that described for the conventional louvers 28. However, as can be seen by comparing FIGS. 12 or 14, which show cross sections taken closer to the crests 46, to FIG. 13, which shows the cross taken in the center, there is a greater effective depth of the louvers 48 closer to the ends of the louvers 48, and closer to the surface of the tubes 20. With the longer louver 48 and greater effective depth D', more air closer to the surface of a tube 20 can be scooped in and through a fin wall 44, minimizing laminar buildup along the surface of tube 20. In addition, with the ends of the louver 48 extending out farther into the flow passage wider area O, more of the air flow that might otherwise simply pass straight through and between the fin walls 44 is caught. This so called "by pass flow" is more pronounced with divergent fin walls 44 and their wider flow passage areas O. It may also be that the flow through the better aligned openings formed by the louvers in adjacent fin walls 44 is smoother or better defined. All of the flow mechanisms and changes induced by the novel geometry of louver 48 are not perfectly understood at this point. In any case, it has been calculated that for comparable louver width, fin wall width, fin wall angle, and tube spacing, the heat transfer coefficient of the louver 48 of the invention, compared to that of the longest possible prior an louver 28, showed approximately a 13 percent improvement. This is much larger quantitatively than the corresponding increase in relative louver length of only 2 per cent. Therefore, it appears that the differing orientation of the louver 48, in addition to its longer length, must have an effect on its operation.

Variations in the embodiment disclosed could be made. Most fundamentally, a louvered, corrugated fin, including the particular design disclosed here, could be used internally to a flow tube, creating flow passages for a liquid, not just air. As already noted, the fin walls could be nearly parallel to one another (and square to the tubes), rather than V shaped or divergent. The louvers could be formed all with the same general direction or slope, rather than in adjacent sets with alternating slope, though that is the far more common configuration. When the louvers are in adjacent sets with alternating slope, the most common configuration is only two such sets, one leading and one trailing. However, three or more sets, each alternating in slope from the next, are possible. The louvers in any set could be rotated farther about their oblique axes than illustrated, the only limitation being that they not be so wide or rotated so far as to abut and interfere with the louvers in adjacent fin walls within the wider areas of the flow passages. Again, that is a far less restrictive limitation than avoiding interference inboard of the more restricted inner surface of a fin crest. Therefore, it will be understood that it is not intended to limit the invention to just the embodiment disclosed.

We claim:

1. A corrugated heat exchanger fin (42) comprising a series of flat walls (44) integrally folded at alternating crests (46) with a predetermined fin wall width (W) measured between crests, said crests (46) being adapted to be bonded to parallel, flat heat exchanger tubes (20) so as to form fluid flow passages (F) enclosed between adjacent fin walls (44) and said tubes (20) through which a fluid is forced in a direction generally parallel to said crests (46) and with each fin wall (44) separating a pair of adjacent flow passages (F) from each other, each of said adjacent flow passages (F) also having a constricted area (C) within the inner surface of a crest (46) and an opposed unconstricted area (O) between the outer surfaces of two adjacent crests (46), characterized in that, each fin wall (44) is formed with a series of integral, substantially planar louvers (48) bent out of said wall (44), each of said louvers (48) having a length generally parallel to said fin wall (W) width, each louver being tilted out of and through the plane of its fin wall (44) about an oblique axis so as to move one diagonal half of said louver (48) substantially entirely to one side of said fin wall (44) and concurrently move the other diagonal half of said louver (48) substantially entirely to the other side of said fin wall (44), thereby moving diagonally opposed corners of said louver (48) into the unconstricted (O) areas of, and out of the constricted (C) areas of the adjacent flow passages (F) respective to each of said fin walls (44).

2. A fin (42) according to claim 1 further characterized in that said fin walls (44) are generally V shaped and divergent relative to one another.

3. A fin (42) according to claim 1 or 2 further characterized in that said louvers (48) are arranged in alternating adjacent patterns with the louvers (48) in one pattern being tilted in one direction and in adjacent pattern tilted in the opposite direction.

* * * * *